United States Patent [19]

Weckman et al.

[11] Patent Number: 4,755,285

[45] Date of Patent: Jul. 5, 1988

[54] PROCESS FOR THE FROTH-FLOTATION OF A PHOSPHATE MINERAL, AND A REAGENT INTENDED FOR USE IN THE PROCESS

[75] Inventors: Anders Weckman, Helsinki; Esko T. Kari, Espoo; Jarmo Aaltonen, Siilinjärvi, all of Finland

[73] Assignee: Kemira Oy, Malminkatu, Finland

[21] Appl. No.: 850,814

[22] Filed: Apr. 11, 1986

[30] Foreign Application Priority Data

Oct. 10, 1985 [FI] Finland ..... 853942

[51] Int. Cl.[4] ..... B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 3,830,366 | 8/1974 | Day | 209/166 |
| 4,043,902 | 8/1977 | Hartjens | 209/166 |
| 4,138,350 | 2/1979 | Wang et al. | 252/61 |
| 4,139,482 | 2/1979 | Holme | 209/166 |
| 4,192,739 | 3/1980 | Wang et al. | 209/166 |
| 4,199,064 | 4/1980 | Holme | 209/166 |
| 4,317,715 | 3/1982 | Hintikka et al. | 209/167 |

FOREIGN PATENT DOCUMENTS

| | | | |
|---|---|---|---|
| 63527 | 7/1983 | Finland . | |
| 64755 | 1/1984 | Finland . | |
| 749434 | 7/1980 | U.S.S.R. | 209/166 |
| 862990 | 9/1981 | U.S.S.R. | 209/166 |
| 1113174A | 9/1984 | U.S.S.R. . | |

*Primary Examiner*—Kenneth M. Schor
*Assistant Examiner*—Thomas M. Lithgow
*Attorney, Agent, or Firm*—Marshall, O'Toole, Gerstein, Murray & Bicknell

[57] ABSTRACT

The invention relates to a process for the separation of phosphate minerals from a phosphate ore, especially from a phosphate-carbonate ore, by using in the flotation as the reagent selective for phosphate mineral a compound having the general formula I, or a salt or amide of the same, in which formula X is —CH—CH—, Y is n is a number 0–40, in which case, when n is greater than 1, groups may be the same or different, m is 0 or 1, B is —NRR$^2$ or, when m and n are 0, R is H, R$^3$ or and R$^1$, R$^2$, R$^3$, R$^4$ and R$^5$, which may be the same or different, each stand for an aromatic, araliphatic or straight-chain or branched aliphatic hydrocarbon which contains 1–30 carbon atoms and which is possibly substituted by an oxygen or nitrogen function, with the exception of sulfosuccinic acid monolkyl amide according to Formula I. The invention also relates to such a reagent.

I

3 Claims, No Drawings

PROCESS FOR THE FROTH-FLOTATION OF A PHOSPHATE MINERAL, AND A REAGENT INTENDED FOR USE IN THE PROCESS

A process for the froth-flotation of a phosphate mineral, and a reagent intended for use in the process.

The present invention relates both to a process for separating phosphate minerals from a phosphate ore, especially from a phosphate-carbonate ore, by flotation in the presence of a reagent selective with respect to phosphate mineral, and to such a reagent.

In the art, a large number of processes and compounds are known for selective froth-flotation of phosphate minerals from ores which contain phosphate. One such process is presented in Finnish Patent Application No. 811333, corresponding to U.S. Pat. No. 4,317,715 (Mar. 2, 1982) wherein an anionic collector agent, usually a fatty acid, is first added to an aqueous slurry of the ore or of its concentrate, whereafter the slurry is subjected to flotation in order to remove a silicate-containing waste from the concentrate. Next, the slurry is treated with an alkali in order to remove the collector-agent covers from the mineral surfaces. Finally the combined concentrate is floated by using a cationic collector agent, especially an amine-type collector agent, the pH being neutral or mildly acidic in order that the phosphate concentrate be separated in as pure a form as possible.

From Finnish Patent Application No. 790725 there is also known an amphoteric surface-active agent to be used as a collector agent. Such an agent has been obtained, for example, by allowing a suitable amino compound, e.g. methyl alanine or methyl glycine, to react with an epoxy or chlorohydrine compound. In order to obtain the best result, the hydrophilic and hydrophobic portions of the collector agent can, in this as in other known amphoteric agents, be varied by adjusting the length of the carbon chain and, for example, the number of ether bonds.

From Finnish Patent Application No. 783804 corresponding to U.S. Pat. Nos. 4,138,350 (Feb. 6, 1979) and 4,192,739 (Mar. 11, 1980). there is known a collector agent composition which is based on a monoester of sulfosuccinic acid and a fatty acid based on a vegetable or animal oil, the contents of the constituents in the composition ranging from 1–99% to 99–1%, calculated according to the weight.

From Finnish Pat. No. 64755 there is known a method of concentrating phosphate-containing minerals from systems which contain carbonate and silicate, by first carrying out a flotation at a pH of over 6 by means of an amidocarboxylic acid type collector agent in the presence of a depressing agent and by thereafter subjecting the obtained froth product to a selective secondary flotation at a pH value of 4–5.5. The collector agent used may have the general formula

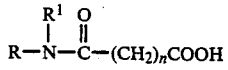

where R is a saturated or unsaturated aliphatic group which contains 7–30 carbon atoms, $R^1$ is hydrogen or an alkyl group which contains 1–4 carbon atoms, and n is 1–8.

Furthermore, from SU Pat. No. 1,113,174 there is known a process for the flotation of an aqueous suspension of a finely-ground phosphate ore in the presence of N-alkyl sulfosuccinamate in order to separate apatite matte from the gangue. [cf. also Chemical Abstracts 101 (26)233743p].

At present, fatty acids are perhaps the most commonly used collector agents. The fatty acids may be unsaturated or, for example, technical fatty acid compositions. There are also other compounds among the proposed collector agents, such as alkyl benzene sulfonate, alkyl sulfate, and amines.

In order to improve the selectivity of the separation of phosphate and carbonate minerals, and in order to improve the yield, various regulating chemicals are often also used in flotation. By using additives it is often also possible to decrease the total consumption of chemicals and/or the costs. Generally known regulating chemicals include waterglass, corn starch, gum arabic, CMC, mineral oil, carbon or sulfur dioxide gas, and various emulsifiers and frothing oils. The known processes and chemicals have the disadvantage that the grade of the phosphate concentrate usually remains low when the aim is a high yield, especially as carbonate minerals float along with phosphates.

The object of the present invention is to provide a process by which phosphate minerals such as apatite can be separated effectively and selectively from other minerals. According to the invention, the reagent used in the flotation as the reagent selective with respect to phosphate mineral consists of certain maleic acid and/or sulfosuccinic acid derivatives, previously unknown for this purpose, which improve the yield and the selectivity, especially with respect to carbonate minerals. The invention is characterized in that the reagent used as the reagent selective with respect to phosphate mineral consists of one or several compounds having the general formula

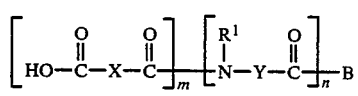

I or a salt or amide

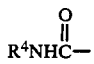

of the same, in which formula X is —CH=CH—,

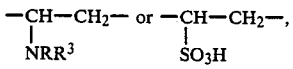

Y is

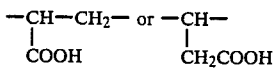

n is a number 0–40, in which case, when n is greater than 1, the groups

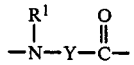

may be the same or different, m is 0 or 1, B is —NRR$^2$ or, when m and n are 0,

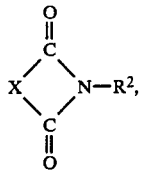

R is H, R$^3$ or

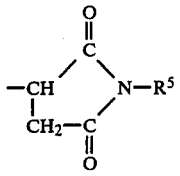

and R$^1$, R$^2$, R$^3$, R$^4$ and R$^5$, which may be the same or different, each stand for an aromatic, araliphatic or straight-chain or branched aliphatic hydrocarbon which contains 1–30 carbon atoms and which is possibly substituted by an oxygen or nitrogen function, with the exception of sulfosuccinic acid monoalkyl amide according to Formula I.

Preferred salts of the compounds according to Formula I are alkali metal salts and ammonium salts.

The reagents according to the invention work with both magmatic and sedimentary phosphate ores.

Some of the recommended reagents according to the invention are monoamide of maleic acid, having the formula

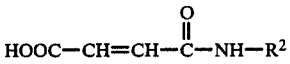

Ia monoamide of aminosuccinic acid, having the formula

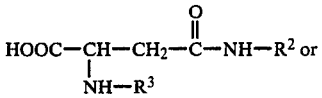

Ib

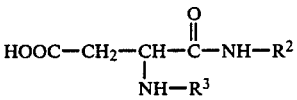

Ib' and a composition of compounds Ib and Ib', imide of maleic acid, having the formula

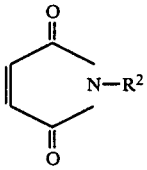

Ic and imide of sulfosuccinic acid, having the formula

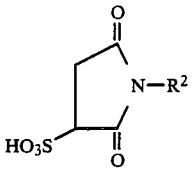

Id and compounds according to the following formulas

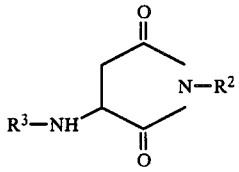

Ie

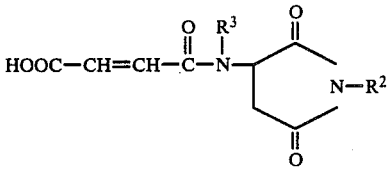

If

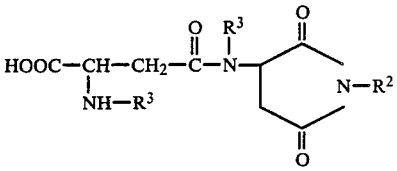

Ig

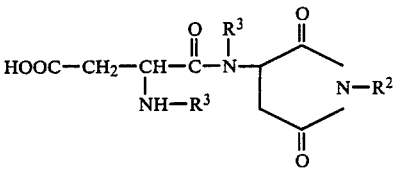

Ig' and a composition of compounds Ig and Ig',

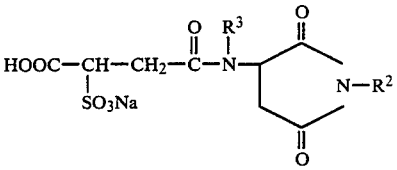

Ih

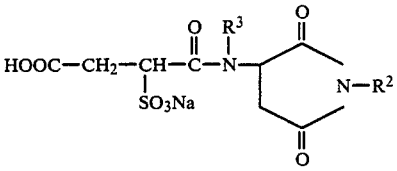

Ih' and a composition of compounds Ih and Ih'

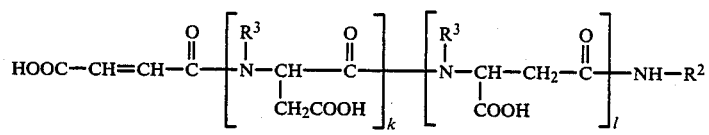

Ii

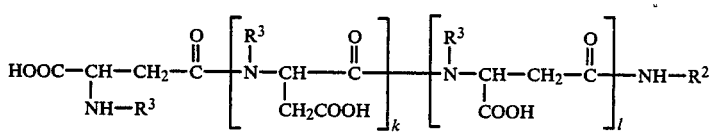

Ij

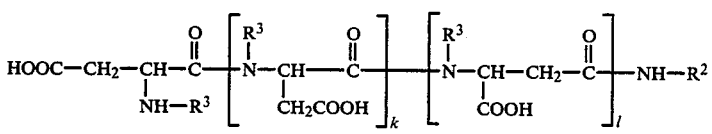

Ij' and a composition of compounds Ij and Ij'

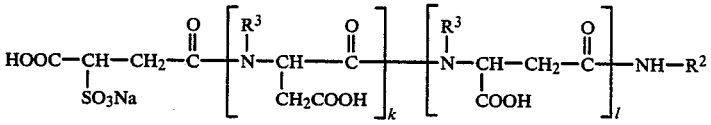

Ik

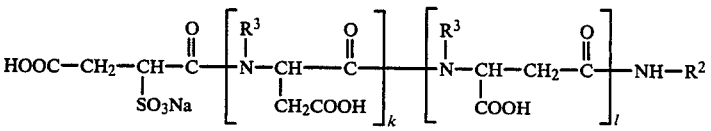

Ik' and a composition of compounds Ik and Ik' and their alkali metal and ammonium salts and amides

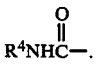

In the formulas presented above, $R^2$ and $R^3$ preferably each stand for a saturated or unsaturated aliphatic hydrocarbon which contains 1–22 carbon atoms and may be substituted by one or several oxygen or nitrogen functions, or for phenyl or benzyl, and k is an integer within the range 0–40 and 1 is an integer within the range 0–40, provided, however, that $k+1=1$–40. Especially advantageously $R^2$ and $R^3$ each stand for a hydrocarbon group which contains 12–22 carbon atoms, such as a hydrocarbon group derived from tallow fat.

As mentioned above, from SU Pat. No. 1,113,174 there is known N-alkyl sulfosuccinamate, i.e. monoalkyl amide of sulfosuccinic acid. It has now been observed surprisingly that sulfosuccinic acid imide according to Formula Id is a collector agent more selective with respect to apatite than is the corresponding monoalkyl amide known from said SU Pat. No. 1,113,174 and that it leads to better yields and better froth quality than does the corresponding monoalkyl amide, as is evident from the comparison examples presented below.

Furthermore, it has been observed surprisingly that maleic acid monoamide according to Formula Ia leads to better flotation results than does amidocarboxylic acid of a highly similar structure, known from FI Pat. No. 64 755.

The compounds according to Formula I are known, or they can be prepared by methods known per se, see for example U.S. Pat. No. 2,252,401.

Maleic acid monoamide according to Formula Ia can be prepared from alkyl amine and maleic acid anhydride, either by combining them dissolved in a solvent or by melting them together. The reaction is as follows

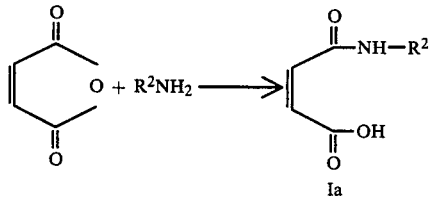

(1)

When maleic acid monoamide (Ia) is heated at about 100° C. or when an imidization reagent is used, the respective imide is produced (Ic). After about 6–12 hours of heating the product will already be mainly imide. Reaction equation 2 shows the formation of imide.

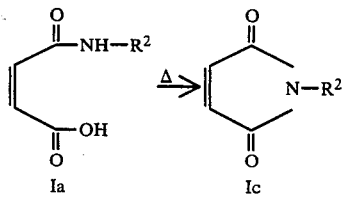

(2)

Sulfosuccinimide according to Formula Id can be prepared by sulfonating maleic acid monoamide (Ia) by means of sodium hydrogen sulfite and by thereafter carrying out an imidization by a few hours' heating at about 100° C. The reactions are shown in Equation 3.

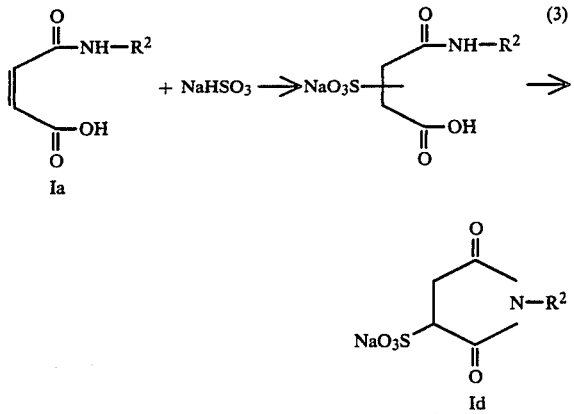

Aminosuccinic acid monoamides according to Formulas Ib and Ib' can be prepared by causing maleic acid monoamide (Ia) to react with amine, and aminosuccinic acid imide according to Formula Ie can be prepared by imidizing the obtained aminosuccinic acid monoamide (Ib or Ib', or a composition of the same). The reactions are shown in Equation 4.

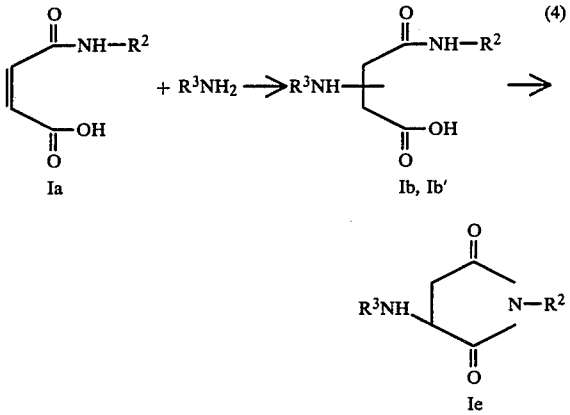

The compound according to Formula If can be prepared according to Equation (1) by causing compound Ie to react with maleic acid anhydride.

The compound according to Formula Ii can be prepared according to Equation (1) by causing compound Ib and/or Ib' to react with maleic acid anhydride.

The compounds according to Formulas Ig and Ig', or compositions of the same, can be prepared according to Equation (4) from compound If.

The compounds according to Formulas Ij and Ij', and compositions of the same, can be prepared according to Equation (4) from compound Ii.

The compounds according to Formulas Ih and Ih', and compositions of the same, can be prepared according to Equation (3) by sulfonating compound If.

The compounds according to Formulas Ik and Ik', and compositions of the same, can be prepared according to Equation (3) by sulfonating compound Ii.

When an above-mentioned compound according to Formula I, or a composition of the same, is used for froth-flotation, the selectivity, the purity and the yield, as well as the grade of the froth, are improved. It is possible to use in the flotation conventional regulating agents known in the art, such as depressing agents, emulsifiers, dispersing agents and frothing oils. The conventional physical conditions such as the temperature and the pH of the slurry are also regulated in the known manner in the flotation process. Other auxiliary chemicals and pH control are not necessarily required in the process according to the invention, and it has even been shown that good results are obtained with one flotation, without pH control and without auxiliary chemicals.

The invention is illustrated below with examples.

EXAMPLE 1

A phosphate-carbonate ore which contained 11.5% fluorapatite, 8.3% carbonates, the balance being silicate minerals, was crushed to a particle size under 3 mm. A 1-kg batch of the homogenized ore was ground with 0.7 liter water to a fineness of 43.3%-74 μm. The ground material was slurried into 3 liters water, the pH of the slurry was adjusted to 10 by means of alkali, and a hydrocarbon imide of sulfosuccinic acid, in which the hydrocarbon was from tallow fat, was added at a rate of 200 g/t to the slurry, and the slurry was conditioned for 10 minutes. Thereafter a preliminary flotation was carried out in a 3-liter cell, and the obtained preliminary concentrate was subjected to 3 repeat flotations in a 1.5-liter cell, whereby the following results were obtained:

| | % $P_2O_5$ | Yield, % |
|---|---|---|
| Ore | 4.8 | |
| Apatite concentrate | 28.2 | 74.1 |

EXAMPLE 2

A phosphate-carbonate ore which contained 9.6% fluorapatite, 9.0% carbonates, the balance being silicate minerals, was crushed to a particle size under 3 mm. A 1-kg batch of the homogenized ore was ground with 0.7 liter water to a fineness of 36.3%-74 μm. The ground material was slurried into 3 liters water, and a compound having the structure

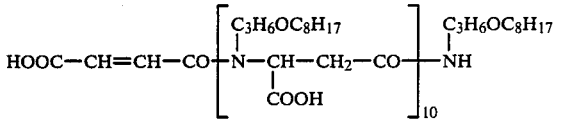

was added at a rate of 200 g/t to the slurry, and the slurry was conditioned for 10 minutes. The pH of the slurry was not adjusted (pH 10.3–8.5). Thereafter, a preliminary flotation was carried out in a 3-liter cell, and the obtained preliminary concentrate was subjected to 3 repeat flotations in a 1.5-liter cell, whereby the following results were obtained:

| | % $P_2O_5$ | Yield, % |
|---|---|---|
| Ore | 4.0 | |
| Apatite concentrate | 30.6 | 93.2 |

By following the procedure presented in Example 1, but by varying the chemicals used and/or their amounts, the following results were obtained.

Note

The structure of the long-chain collector agents presented in the table are presented in a simplified form. In fact, when the collector agents in question are synthetized, there are formed compositions in which both

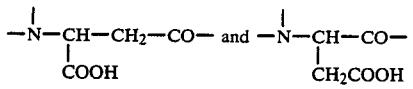

groups are present.

| Example No. | Collector agent | Batching g/t | pH | Apatite concentrate % $P_2O_5$ | Apatite concentrate Yield, % |
|---|---|---|---|---|---|
| 1. | 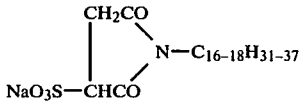 | 200 | 10 | 28.2 | 74.1 |
| 2.* | 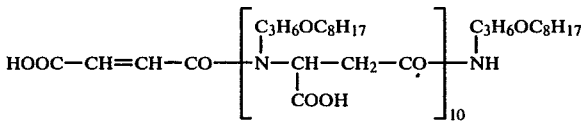 | 200 | natural | 30.6 | 93.2 |
| 3.** | 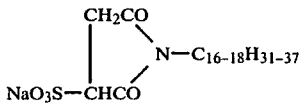 | 200 | natural | 39.2 | 53.5 |
| control | $C_{12}H_{25}NHCOCH_2CH(SO_3Na)COONa$ | 200 | natural | 21.9 | 53.2 |
| control | $C_{16-18}H_{31-37}NHCOCH_2CH(SO_3Na)COOH$ | 200 | natural | 18.0 | 94.1 |
| control | $C_{16-18}H_{31-37}NHCOCH_2CH(SO_3Na)COOH$ | 200 | 10 | 16.2 | 79.1 |
| 4. | 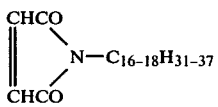 | 200 | natural | 37.7 | 70.2 |
| 5. | 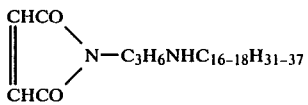 | 200 | natural | 31.2 | 48.9 |
| 6. | 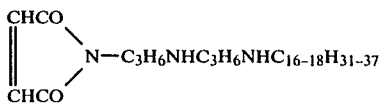 | 200 | natural | 25.6 | 52.1 |
| 7. | $C_{16-18}H_{31-37}NHCOCH{=}CHCOOH$ | 200 | 7 | 36.1 | 57.0 |
| 8. | $C_{16-18}H_{31-37}NHCOCH{=}CHCOOH$ | 200 | 9 | 36.2 | 68.3 |
| 9. | $C_{16-18}H_{31-37}NHCOCH{=}CHCOOH$ | 200 | 10 | 37.0 | 49.8 |
| 10. | $C_{16-18}H_{31-37}NHCOCH{=}CHCOOH$ | 250 | 10 | 33.1 | 81.0 |

-continued
| Example No. | Collector agent | Batching g/t | pH | Apatite concentrate % $P_2O_5$ | Apatite concentrate Yield, % |
|---|---|---|---|---|---|
| control | $C_{16-18}H_{31-37}NHCOCH_2CH_2COOH$ | 200 | 10 | 5.9 | 2.0 |
| control | $C_{16-18}H_{31-37}NHCOCH_2CH_2COOH$ | 200 | natural | 14.0 | 6.1 |
| control | tall oil | 200 | 9 | 7.4 | 86.6 |
| 11. | $C_{12}H_{25}NHCOCH{=}CHCOOH$ | 200 | 10 | 20.1 | 99.9 |
| 12. | $C_{18}H_{35}NHCOCH{=}CHCOOH$ | 200 | 10 | 31.6 | 75.9 |
| 13. | $(C_{18}H_{37})_2NCOCH{=}CHCOOH$ | 200 | 10 | 34.6 | 13.4 |
| 14. | $C_{13}H_{27}OC_3H_6NCOCH{=}CHCOOH$ | 200 | 10 | 13.5 | 72.4 |
| 15. | 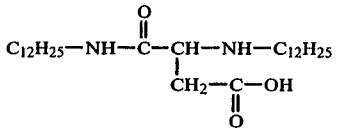 | 200 | natural | 19.4 | 74.5 |
| 16. | 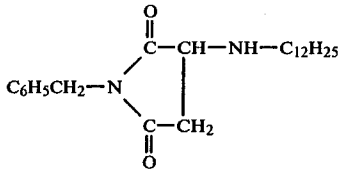 | 200 | natural | 25.7 | 60.8 |
| 17. | 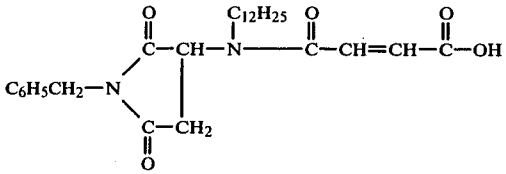 | 100 | natural | 15.0 | 79.9 |
| 18. | 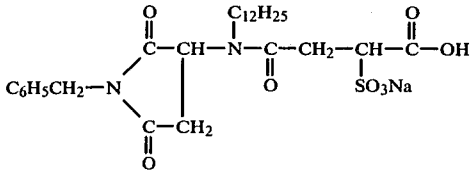 | 200 | natural | 11.5 | 91.9 |
| 19. | 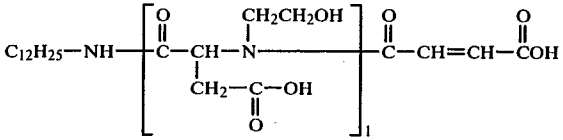 | 200 | natural | 24.2 | 59.6 |

-continued
| Example No. | Collector agent | Batching g/t | pH | Apatite concentrate % $P_2O_5$ | Yield, % |
|---|---|---|---|---|---|
| 20. | 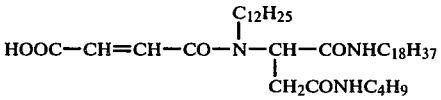 | 200 | natural | 22.5 | 41.6 |
| 21. | 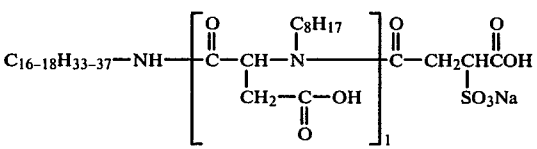 | 200 | natural | 16.4 | 90.4 |
| 22* | 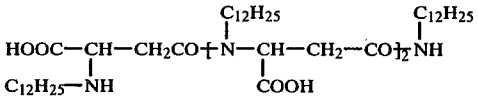 | 200 | natural | 24.6 | 86.6 |
| 23* | 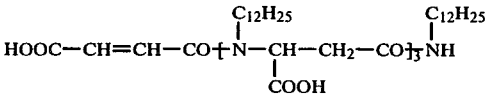 | 200 | natural | 23.0 | 91.8 |
| 24* | 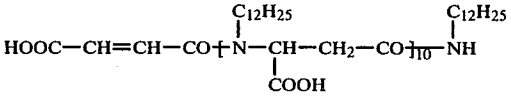 | 200 | natural | 37.5 | 47.5 |
| 25* | 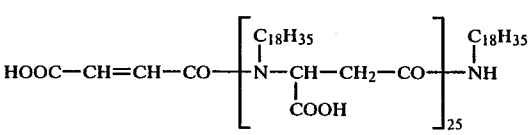 | 200 | natural | 33.6 | 72.9 |
| 26* | 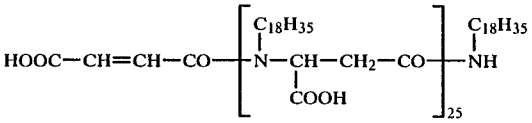 | 200 | natural | 37.9 | 21.7 |

-continued
| Example No. | Collector agent | Batching g/t | pH | Apatite concentrate % $P_2O_5$ | Apatite concentrate Yield, % |
|---|---|---|---|---|---|
| 27*. | 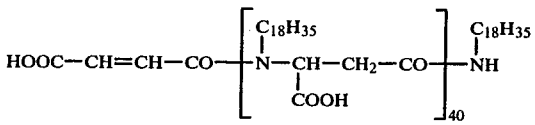 | 200 | natural | 28.9 | 41.3 |
| 28*. | 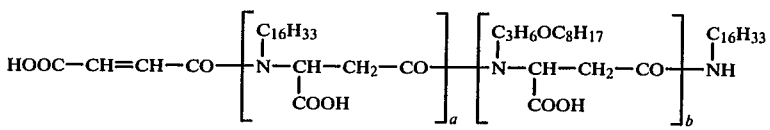 a + b = 10 | 200 | natural | 16.6 | 95.4 |
| 29*. | 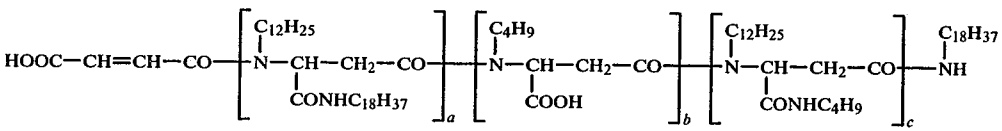 a + b + c = 10 | 200 | natural | 19.6 | 57.6 |
*see Note on page 13
**the ore was ground to a fineness of 33% - 74 μm

We claim:

1. A process for the separation of phosphate minerals from a phosphate ore comprising froth flotation of the phosphate minerals in the presence of a reagent which is selective with respect to the phosphate minerals, said reagent being selected from the group consisting of compounds having the general formula

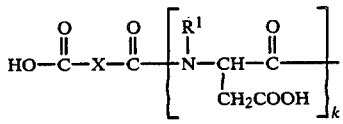

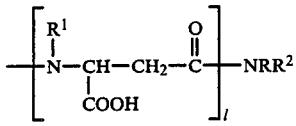

or a salt or amide $R^4NHC$— thereof, wherein X is —CH=CH—,

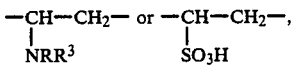

k is a number 0–40, and 1 is a number 0–40, provided, however, that k+1=1–40,

R is H, $R^2$ or

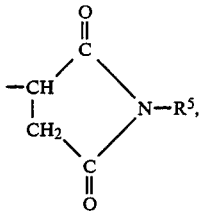

$R^1$, $R^2$, $R^3$, $R^4$ and $R^5$ may be the same or different and are selected from the group consisting of aromatic, araliphatic, and straight or branched aliphatic hydrocarbon groups having 1–30 carbon atoms, and straight or branched aliphatic hydrocarbon having 1–30 carbon atoms and including an ether linkage or hydroxyl substituent.

2. The process of claim 1 wherein said reagent is a compound having the general formula

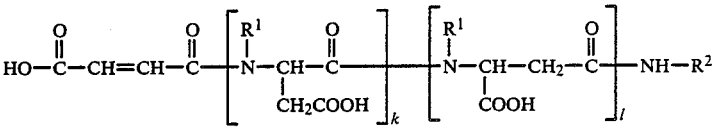

wherein $R^1$ and $R^2$ are selected from the group consisting of saturated or unsaturated hydrocarbon groups having 12–22 carbon atoms, and saturated or unsaturated hydrocarbon groups having 12–22 carbon atoms and including an ether linkage or a hydroxyl substituent.

3. The process of claim 1 wherein said phosphate ore comprises a phosphate-carbonate ore.

* * * * *